US011486169B2

(12) United States Patent
Beck et al.

(10) Patent No.: US 11,486,169 B2
(45) Date of Patent: Nov. 1, 2022

(54) EXTERIOR DOOR HANDLE FOR A VEHICLE

(71) Applicant: Huf Hülsbeck & Fürst GmbH & Co. KG, Velbert (DE)

(72) Inventors: Andreas Beck, Bochum (DE); Serdal Bitirim, Velbert (DE); Dirk Müller, Essen (DE); Martin Witte, Ahaus (DE)

(73) Assignee: HUF HÜLSBECK & FÜRST GMBH & CO. KG, Velbert (DE)

( * ) Notice: Subject to any disclaimer, the term of this patent is extended or adjusted under 35 U.S.C. 154(b) by 726 days.

(21) Appl. No.: 15/745,108

(22) PCT Filed: Jul. 4, 2016

(86) PCT No.: PCT/EP2016/065636
§ 371 (c)(1),
(2) Date: Jan. 15, 2018

(87) PCT Pub. No.: WO2017/009076
PCT Pub. Date: Jan. 19, 2017

(65) Prior Publication Data

US 2019/0017303 A1 Jan. 17, 2019

(30) Foreign Application Priority Data

Jul. 13, 2015 (DE) ..... 10 2015 111 311.2
Oct. 29, 2015 (DE) ..... 10 2015 118 523.7
(Continued)

(51) Int. Cl.
*E05B 81/76* (2014.01)
*E05B 85/10* (2014.01)
*E05B 1/00* (2006.01)

(52) U.S. Cl.
CPC ..... *E05B 81/76* (2013.01); *E05B 1/0015* (2013.01); *E05B 81/77* (2013.01); *E05B 85/10* (2013.01)

(58) Field of Classification Search
CPC ..... E05B 85/10; E05B 85/103; E05B 1/00; E05B 85/107; E05B 85/12; E05B 85/13;
(Continued)

(56) References Cited

U.S. PATENT DOCUMENTS 3,876,977 A * 4/1975 Ladewig ..... B60Q 5/003 200/61.57
6,588,813 B1 * 7/2003 Marcarini ..... E05B 85/16 292/336.3
(Continued)

FOREIGN PATENT DOCUMENTS

CN 103492652 A 1/2014
CN 104453493 A 3/2015
(Continued)

OTHER PUBLICATIONS

Machine Translation of KR 20150075652 A abstract, 2020, p. 1 (Year: 2020).*
(Continued)

*Primary Examiner* — Christine M Mills
*Assistant Examiner* — Yahya Sidky
(74) *Attorney, Agent, or Firm* — Intellectual Property Law Group LLP

(57) ABSTRACT

An exterior door handle for a vehicle particularly for an activation of an electric lock of the vehicle comprising:

a door handle body with a wall, wherein the door handle body is configured such that an activation action is performable by a user at the door handle body in the deformation area, at least one inductive activation means which is arranged in the deformation area, (Continued)

at least one sensor device arranged within the door handle body for inductivity measurements at the activation means, wherein the door handle body is at least configured elastically deformable in the deformation area and the sensor device for the detection of the activation action is arranged spaced apart to the activation means such that the deformation of the door handle body is detectable by the inductivity measurement.

17 Claims, 9 Drawing Sheets

(30) Foreign Application Priority Data

Oct. 29, 2015 (DE) ..... 10 2015 118 525.3
Dec. 18, 2015 (EP) ..... 15201091

(58) Field of Classification Search
CPC ..... E05B 85/14; E05B 85/16; E05B 85/18; Y10T 292/57; Y10S 292/63
USPC ..... 292/336.3, DIG. 63
See application file for complete search history.

(56) References Cited

U.S. PATENT DOCUMENTS 6,648,493 B2 * 11/2003 Klein ..... B60Q 1/2669 362/100
6,740,834 B2 * 5/2004 Sueyoshi ..... B60R 25/246 200/293.1
6,998,968 B2 * 2/2006 Garnault ..... E05B 81/78 340/426.28
7,029,054 B2 * 4/2006 Kobayashi ..... E05B 79/06 296/1.02
7,057,124 B2 * 6/2006 Ieda ..... E05B 81/76 200/520
7,192,285 B2 * 3/2007 Makino ..... E05B 81/78 200/600
7,199,317 B2 * 4/2007 Ieda ..... E05B 81/78 200/600
7,504,601 B2 * 3/2009 Belmond ..... E05B 81/76 200/61.62
7,559,120 B2 * 7/2009 Fujiwara ..... B29C 45/14639 16/412
7,597,364 B2 * 10/2009 Muneta ..... B60R 25/246 292/336.3
7,751,664 B2 * 7/2010 Ieda ..... B60Q 1/2669 250/216
7,931,314 B2 * 4/2011 Nitawaki ..... B60R 25/246 292/336.3
7,984,938 B2 * 7/2011 Tanimoto ..... E05B 81/78 292/336.3
8,403,384 B2 * 3/2013 Ieda ..... B60R 25/246 292/336.3
8,408,610 B2 * 4/2013 Ieda ..... E05B 81/78 292/1
8,416,092 B2 * 4/2013 Witte ..... E05B 81/78 292/336.3
8,454,062 B2 * 6/2013 Rohlfing ..... E05B 81/78 292/336.3
8,601,903 B1 * 12/2013 Klein ..... E05B 81/78 16/110.1
8,690,204 B2 * 4/2014 Lang ..... E05B 81/77 292/279
8,801,245 B2 * 8/2014 De Wind ..... B60Q 1/2665 362/511
9,022,435 B2 * 5/2015 Park ..... E05B 1/0007 292/217
9,033,379 B2 * 5/2015 Tateishi ..... E05B 85/16 292/336.3
9,156,335 B1 * 10/2015 Harter ..... E05B 81/76
9,193,309 B2 * 11/2015 Toyama ..... B60R 13/00
9,353,557 B2 * 5/2016 Sanborn ..... E05B 85/14
9,416,565 B2 * 8/2016 Papanikolaou ..... E05B 77/28
9,834,964 B2 * 12/2017 Van Wiemeersch .... E05B 85/14
9,903,142 B2 * 2/2018 Van Wiemeersch .... E05B 81/76
9,957,737 B2 * 5/2018 Patel ..... E05B 81/76
9,988,829 B2 * 6/2018 Guibbert ..... E05B 81/77
9,995,065 B2 * 6/2018 Witte ..... E05B 85/16
10,075,163 B2 * 9/2018 Nishiyama ..... H03K 17/975
10,139,514 B2 * 11/2018 Guibbert ..... E05B 81/78
10,207,633 B2 * 2/2019 Takahashi ..... E05B 17/10
10,385,595 B2 * 8/2019 Witte ..... G07C 9/00174
10,424,835 B2 * 9/2019 Ueda ..... H01Q 1/3283
10,662,682 B2 * 5/2020 Beck ..... G07C 9/00944
2002/0005016 A1 * 1/2002 Menke ..... E05B 81/76 49/503
2003/0009855 A1 * 1/2003 Budzynski ..... E05B 85/10 16/443
2003/0029210 A1 * 2/2003 Budzynski ..... E05B 85/10 70/278.1
2005/0057047 A1 * 3/2005 Kachouh ..... E05B 81/14 292/201
2007/0227203 A1 * 10/2007 Weber ..... E05B 81/78 70/91
2011/0012378 A1 * 1/2011 Ueno ..... E05B 81/78 292/336.3
2012/0133159 A1 * 5/2012 Tateishi ..... E05B 81/77 292/336.3
2012/0133563 A1 * 5/2012 Naka ..... E05B 81/77 343/713
2014/0246873 A1 * 9/2014 Raulin ..... E05B 81/78 292/336.3
2014/0292004 A1 * 10/2014 Ruse ..... E05B 85/10 292/336.3
2015/0337571 A1 * 11/2015 Henderson ..... G07C 9/37 701/49
2016/0251880 A1 * 9/2016 Bingle ..... E05B 81/76 701/49
2017/0030119 A1 * 2/2017 Usui ..... E05B 85/10
2017/0074009 A1 * 3/2017 Banter ..... E05B 81/77
2017/0159332 A1 * 6/2017 Beck ..... E05B 85/16
2017/0234033 A1 * 8/2017 DeBoer ..... E05C 1/06 49/449
2017/0306662 A1 * 10/2017 Och ..... E05B 81/78
2018/0209182 A1 * 7/2018 Beck ..... E05B 1/0015
2019/0390487 A1 * 12/2019 Spick ..... E05B 81/77
2020/0011096 A1 * 1/2020 Leonardi ..... E05B 81/78

FOREIGN PATENT DOCUMENTS

FR 2217784 A1 * 9/1974 ..... E05B 81/76
FR 2825743 A1 12/2002
KR 20150075652 A * 7/2015
WO WO 0140607 A1 6/2001
WO WO 2014188257 A1 11/2014
WO WO 2017/009076 A1 1/2017

OTHER PUBLICATIONS

Wayback Machine archived data sheet for Texas Instruments LDC1000 Inductance to Digital Converter (www.ti.com/lit/ds/symlink/ldc1000.pdf); archived on Oct. 8, 2013; pp. 1-28 (Year: 2013).*
China Office Action dated Sep. 20, 2019 for corresponding China application No. 201680041682.8 with English translation.
European Office Action dated Oct. 7, 2019 for corresponding European application No. 16 736 049.4 with English translation.
International Search Report, dated Sep. 22, 2016 for corresponding International Application No. PCT/EP2016/065636 with English translation.
Written Opinion of the ISA, dated Sep. 22, 2016 for corresponding International Application No. PCT/EP2016/065636 with English translation.
International Preliminary Report on Patentability, dated Jan. 16, 2018, for corresponding International Application No. PCT/EP2016/065636 with English translation.

(56) References Cited

OTHER PUBLICATIONS

China Office Action dated Mar. 5, 2019 for corresponding China application No. 201680041682.8 with English translation.

* cited by examiner

Section A-A

Section B-B

EXTERIOR DOOR HANDLE FOR A VEHICLE

CROSS-REFERENCE TO RELATED APPLICATIONS

This application is a U.S. National Phase application, under 35 U.S.C. § 371, of International Application no. PCT/EP2016/065636, with an international filing date of Jul. 4, 2016, and claims benefit of German Application no. 10 2015 111 311.2 filed on Jul. 13, 2015, German Application no. 10 2015 118 523.7 filed on Oct. 29, 2015, German Application no. 10 2015 118 525.3 filed on Oct. 29, 2015, and European Application no. 15 201 091.4 filed on Dec. 18, 2015, each of which are hereby incorporated by reference for all purposes.

BACKGROUND OF THE INVENTION

1. Field of the Invention

The invention relates to an exterior door handle for a vehicle, particularly for an activation of an electric lock of a vehicle. Further, the invention relates to a method for a detection of an activation action at an exterior door handle of a vehicle.

2. Background

From the state of the art it is known that exterior door handles of vehicles are used for activating an electric lock for the vehicle. The electric lock is for example an electrically actuatable door lock. The unlocking of a lock can for example be initiated by an identification device, which herefore for example for the authentification transmits a code to a safety system of the vehicle. It may be possible that an activation, like a wake up of the identification device and/or an unlocking or an opening of the lock only occurs with or after approaching of the user or a hand of the user, and/or an application of force by the user at a door handle body of the exterior door handle with or after a performed authentification. The approaching or application of force is detected by sensors of the exterior door handle.

It is turned out as a disadvantage that the detection by the sensors is often error-prone and/or susceptible to interferences. Thus, capacitive sensors can for example be used for the detection of the approaching wherein external influences like moisture or rain often lead to erroneous detections. Likewise, the sensitivity for the detection can be insufficient, whereby the comfort for the user is consequently diminished during the activation of the electric lock. Further, the arrangement of the corresponding sensors cannot be sufficiently adjusted to the given configuration of the door handle body. Hereby, further disadvantages concerning the comfort and increased space requirement result.

SUMMARY OF THE INVENTION

The invention has the object to at least partially avoid the previously described disadvantages. Particularly, it is object of the invention to detect an activation action of the user more reliably, more correctly and/or more comfortably.

The previous object is solved by an exterior door handle with the features of claim 1 and by a method with the features of claim 13. Further features and details of the invention result from the respective dependent claims, the description and the drawings. Thereby, features and details which are described in relation to the exterior door handle according to the invention naturally also apply in relation to the method according to the invention and vice versa such that according to the disclosure of the individual invention aspects it is or can always be reciprocally related to.

The object is particularly solved by an exterior door handle for a vehicle, particularly for an activation of an electric lock for a vehicle, wherein the exterior door handle preferably comprises a door handle body with a wall. Hereby, it is provided that the door handle body is configured such that an activation action by the user at the door handle body is performable in a deformation area.

Further, the exterior door handle preferably comprises:

- at least an elastically deformable and/or inductive, meaning particularly inductively acting, activation means which is preferably arranged in the deformation area and particularly preferably in and/or at the wall (of the door handle)
- at least one sensor device arranged within the door handle body for the inductive measurement at the activation means, wherein the door handle body and/or the activation means are elastically deformable particularly exclusively or at least in the deformation area.

It can be further provided that the sensor device is supported at at least one sensor bearing point preferably at a bearing point of the door handle body for the detection of the activation action independently from the deformation area in that the deformation of the door handle body is detectable by the inductivity measurement. A sensor device is therewith supported independent from the door handle body particularly from the (outer wall) and/or the deformation area. The independent bearing occurs preferably in that an alteration of the position and/or displacement and/or deformation of the wall and/or the activation means in the deformation area has (mainly) not in the same manner an effect to the position of the sensor device within the door handle body. Therewith, an inductivity alteration can reliably provide conclusions regarding the existence of the activation action due to the deformation or displacement which is detectable by an inductivity measurement. The activation action is thereby preferably coupled to a force application to the wall of the door handle body, particularly in the deformation area. The bearing point is preferably a bearing for the door handle body and/or for the sensor device (as sensor bearing point) and/or for the outer wall of the door handle body. Further, the sensor bearing point is preferably a bearing for the sensor device and/or for all sensor devices of the exterior door handle. The sensor bearing point is preferably configured spatially separated and are independent from bearing position of the deformation area.

It is particularly provided that the sensor device is arranged spaced apart to the activation means for the detection of the activation action in that the deformation of the door handle body (particularly the wall) is detectable by the inductivity measurement. Moreover, the sensor device serves for the conveyance of the deformation area and/or the activation means in order to detect an activation action of the user. Hereby, the sensor device performs particularly an inductivity measurement activation means since the activation means is preferably configured such that during a deformation and/or alteration of the geometry of the activation means and/or the door handle body an inductivity alteration occurs. The sensor device can evaluate the measured inductivity value in order to detect the activation action. Hereby, the measured inductivity value is compared, for example with a predetermined threshold value in order to only positively detect the activation action by exceeding the threshold values. Particularly, the circumstance is used that the activation action necessarily causes a deformation and therewith and specific alteration of the inductivity while other outer (environmental influences) do not affect such inductivity alterations. Therewith, the advantage is achieved that a detection of the activation action is reliably enabled and a false detection can be prevented.

The activation action particularly is an application of force (by the user) at the door handle body which preferably effects a deformation in the deformation area. The activation action thereby preferably occurs at an outer side (outer area) of the door handle body which is accordingly achievable by the user in the normal operation of the vehicle. The activation action can thereby for example serve for the manual opening and/or closing of a moveable part, wherein the movable part is preferably configured as a door and/or hatch flap of the vehicle. The vehicle preferably is a motor vehicle and/or passenger car and/or truck. Thereby, for example a draw movement and/or a pressing movement at the exterior door handle for the activation action occurs meaning particularly at the door handle body, for example by gripping the door handle body by the hand of the user. Herefore, the user for example grips in a grip recess which is configured between the door handle body and the moveable part. The exterior door handle and in particular the door handle body, is particularly configured such that the user grips behind the door handle body in the door handle recess for the actuation and preferably applies a force to the door handle body to perform the activation action. With a positive detection by the sensor device this effects the activation of the electric lock (and/or the activation of a safety device), for example the unlocking and/or locking and/or opening of the electric lock and/or a control of the drive, for example for unlocking or opening the door.

Further, it can be provided that the activation action by the user only is detectable in the deformation area by the sensor device. Hereby, the advantage is achieved that another action like an application of force at the door handle body is not erroneously interpreted as an activation action. It can also be provided that the door handle body, particularly the wall of the door handle body, is configured outside the deformation area mostly or completely rigid and/or with a lower elasticity in the deformation area.

The exterior door handle and particularly the door handle body can preferably be configured from plastic and/or at least mainly or partially comprise plastic. Further, the door handle body and/or the exterior door handle preferably comprise an (inner) space, at least partially enclosed by the wall, particularly a cavity, wherein the sensor device is preferably arranged within the door handle body meaning in this inner space. The sensor device thereby is preferably arranged completely with all sensors or sensor elements in the inner space of the door handle body. Likewise, an electronic system like the sensor device is thereby casted with a filling element (for example an elastic casting compound) in the inner space. The sensor device for example comprises at least one inductive sensor like an LDC-Sensor (Inductance-To-Digital-Converter or Inductivity-Digital-Converter). The sensor device thereby serves particularly for the (indirect) measurement of the deformation and/or pull movement of the exterior door handle due to the activation action. The activation action therewith provides a deformation action. The door handle body for example comprises a mechanic deformable wall in the deformation area, possibly with a material weakening like a recess and/or with elastically deformable cover parts to allow a deformation in the deformation area by the activation action. Due to the activation action which for example provides a loading of the door handle body like a pulling or pushing load preferably a maximum deformation of approximately 0.01 mm to 2 mm, preferably 0.1 mm to 1 mm, particularly preferred maximum approximately 0.1 mm occurs. The corresponding values can for example be digitally saved as a threshold value in a non-volatile data memory of the sensor device, wherein the threshold values can be read out by the sensor device and can be compared with the measured inductive values for the detection of the activation action. For the deformation, the metrical values are hereby for example transferred into inductivity values and saved as such as threshold value in order to enable a direct comparison through the sensor device with the measured inductivity values. The corresponding conversion factor depends on the geometry of the door handle body and/or the activation means in the deformation area and can for example be determined by experiments. The activation means is particularly arranged in the deformation area such that a deformation in the deformation area or the wall in the deformation area has a direct effect to the structure and/or geometry of the activation means and/or the distance of the activation means to the sensor device. Therewith, a reliable detection of the activation action can occur.

Within the scope of the invention it can further be provided that a support device is provided which supports the sensor device at the sensor bearing point, particularly, at a first sensor bearing point and at a second bearing point, preferably, at the vehicle. The support device comprises for example at least on holding element, particularly, a first support element at a first sensor bearing point and a second holding element at a second sensor bearing point. The support elements are thereby releasably and/or detachably connected at the motor vehicle particularly in the area of the corresponding sensor bearing point and/or at the sensor device. The connection can for example be provided as a screw connection, clips connection or adhesive connection. Thereby, the support elements and/or the support device is preferably configured rigid and/or monolithically or consist of one part. Further, the support device can be arranged preferably (at least partially) with a sensor device within the door handle body particularly in an inner space of the door handle body. The supporting device thereby serves for a reliable attachment of the sensor device at the exterior door handle.

It is further possible that at least a bearing point of the exterior door handle is provided at which particularly the door handle body is bearable at the vehicle preferably by a fastening device and preferably the bearing of the sensor device occurs (likewise) at the bearing point. For example, a first bearing point and a second bearing point are provided in order to bear the exterior door handle, particularly the door handle body at the vehicle. The bearing of the sensor device occurs preferably at the bearing of the exterior door handle particularly the door handle body meaning in the area of the bearing points of the exterior door handle. Thereby, it is particularly enabled that the sensor bearing point is provided at the bearing point and/or arranged identically with the bearing point.

Optionally, it can be provided that at least a sensor bearing point of the sensor device and/or the bearing point of the exterior door handle particularly for the door handle body and/or the wall is configured as a fixed bearing. The sensor bearing point and/or the bearing point particularly provides fixed bearing points which mainly or completely prevent all translational movements of the beared body (meaning for example the sensor device or the exterior door handle or door handle body). It can be further provided that besides the fixed bearing points further lose bearing points are provided for bearing the sensor device and/or the exterior door handle. Hereby, a very reliable bearing of the sensor device results and a bearing of the sensor device independent from movements of the deformation area.

Further, it can be provided that the sensor device is beard independent from the outer wall of the door handle body in the exterior door handle and/or from the activation means particularly in the inner space or within the door handle body. Alternatively or additionally, it is enabled that the bearing point is arranged at at least one bearing point of the door handle body for the bearing of the sensor device (meaning particularly the sensor bearing point). The bearing at the bearing point of the door handle body can thereby for example be configured as a fixed bearing in that the exterior door handle configures a fixed exterior door handle with an immobile door handle body. Alternatively, the door handle body (and possibly the sensor device) can be movably, for example pivotally, mounted at the bearing point. The activation action can thereby occur preferably initially without movement of the (whole) door handle body, for example in that only a false application or false occurs in the deformation area. This application or false can then for example affect a deformation of the wall or the activation means in the deformation area. It can be further enabled that a more powerful application of false than during the activation action affects a movement of the (whole) door handle body relative to the vehicle or to the movable part. Such a movement occurs, however, only when the exterior door handle is not configured as a fixed exterior door handle. The movement is for example a pivoting out relative to the movable part in order to likewise perform an activation of the lock or an unlocking. The movable part is preferably a door or hatch flap of the vehicle at which the exterior door handle is fixed. The sensor device is thereby preferably beared or supported at the bearing point of the door handle body (at the sensor bearing point) such that the sensor device performs the movement of the door handle body in the same manner in the inner space of the door handle body (and particularly the relative distance between the sensor device and the door handle body remains the same). At the same time, the bearing of the sensor device at the bearing point of the door handle body enables that an effect or deformation by the activation action does not affect the sensor device in the same manner. Hereby, particularly the further advantage results that by the supporting device in the inner space a direct fastening of the sensor device can occur at the at least one bearing point (together with the door handle body). Therewith, a reliable bearing of the sensor device and a bearing for the sensor device suitable for the inductivity measurement is enabled.

Within the scope of the invention it can further be an advantage that the exterior door handle is configured as a fixed exterior door handle and is particularly arranged immobile at the vehicle, particularly in a movable part of the vehicle. Alternatively, it is also possible that the exterior door handle is configured as a movable and particularly pivotably mounted exterior door handle. The exterior door handle as a fixed exterior door handle, preferably does not comprise any movable individual components like grope or suchlike which can for example serve for the detection of a force application. The term "movable" has thereby to be separated from the term "deformable" wherein particularly the deformation in contrast to the movement of the movable individual components occurs monolithically and/or as a length alteration and/or at the component made of one part, particularly the wall. For example, during groping, however, a relative movement between the separate individual components occurs. Therefore, the detection of the deformation due to the activation action particularly occurs touchless and/or immobile as inductivity measurement by the sensor device. The term "fixed exterior door handle" particularly also refers to the fact that the exterior door handle is not deflectable and/or pivotable relative to the movable part, particularly relative to a door and/or hatch flap. Thereby, an application of force for the activation of the electric lock or the activation action has to be performed only in a partial area configured as a deformation area of the door handle body and not the whole door handle body relative to the movable part. This has the advantage that a very comfortable and secure opening of the movable part and/or activation of the lock can occur.

Within the scope of the invention it can optionally be provided that the sensor device comprises at least one LDC sensor and/or is configured as a LDC sensor. The LDC sensor thereby serves for the detection of at least an alteration of an inductivity, meaning particularly for the inductivity measurement. Herefore, different components and/or circuits are normally necessary which are connected with a LDC sensor on a chip or in an integrated circuit. The LDC sensor and/or the sensor device is for example configured in order to measure the impedance and the resonance frequency of an LC pivoting circle at the same time. Hereby, the sensor device is preferably insensitive to outer influences like moisture or contamination in the area of the door handle body. Therefore, an error detection by influences like rain which leads to interferences with for example capacitive sensors can be reliably prevented. An error detection by outer influences which effect an application of force at the door handle body can for example be prevented that only a partial area of the door handle body comprises the deformation area and corresponding threshold values are used which are specific for the respective activation action. Thereby, the LDC sensor further has the advantages that it is very sensitive for deformations and can therewith serve particularly fast and reliably for the detection of the activation action. The sensor device has thereby for example a resolution of below 1 micrometer with for example a bit depth for quantizing the measured inductive values of at least 16 Bit or at the least 24 Bit.

It is further possible that within the door handle body, meaning in an inner space of the door handle body, at least two or at least three or at least four sensor devices are arranged, which are for example arranged spread along the inner side of the door handle body. Thereby, the sensor device or sensor devices can be at least arranged at a circuit board and/or electrical connected with an electronic (control) system in the inner space of the door handle body. The electronic system of the exterior door handle can for example be arranged on a circuit board together with a sensor device. The sensor device is preferably arranged on the side of the circuit board facing the deformation area. A further electronic system can be arranged on the same side or the side facing away. The sensor device can for example comprise at least an integrated circuit and/or at least a micro processor and/or at least a coil and/or at least a non-volatile Data memory. Thereby, the sensor devices can be resigned for example to different deformation areas of the door handle body respectively. Hereby, reliably one or multiple activation actions can be detected at different areas of the door handle body.

It is further possible that the activation means is configured as an electrically conducting film and/or conductive (printable) ink and/or an electrically conductive coating and or at least one electrically conducting element, particularly from metal, preferably elastically deformable and/or completely galvanically separated and particularly preferred arranged at the inner side of the door handle body and/or in a structural adjustment of the wall. The activation means is thereby preferably (for example only) arranged at the deformation area and particularly releasably or unreleasably arranged such that a deformation of the wall in the deformation area directly affects the activation means. The structural adjustment of the wall is for example a recess of the wall and particularly effects a material weakening of the wall in the deformation area. Thereby, the structural adjustment thereby comprises for example the complete vehicle related wall of the door handle body at the outer side and/or inner side at the door handle body. Alternatively, the structural adjustment comprises for example 1% to 80%, preferably maximum 30% to 50%, preferably 10% to 70% of the whole wall of the door handle body. The activation means is for example mainly arranged (this also means completely) at or in the (whole) structural adjustment, for example within the recess, and comprises for example 1% to 99%, preferably 30% to 50%, particularly preferred 10% to 70% of the structural adjustment. The activation means can preferably be arranged at the inner side or outer side at the wall in the area of the structural adjustment and/or the deformation area and/or at least partially within the wall. Thereby, the activation means preferably comprises metal and is particularly preferred configured as a metal element. Thus it is for example possible that the activation means is arranged as a metallic film or other electric conductive film in the inner side at the door handle body at the structural adjustment. Further, it can be possible that the activation means is configured as chromium coating of the wall in the detection area. The structural adjustment, particularly the recess, can thereby comprise an extension in the area of 500 $mm^2$ to 20000 $mm^2$, preferably mainly 1200 $mm^2$. The activation means is preferably partly or completely electrically isolated meaning particularly galvanically separated and/or non-electrically connected with an electronic system and/or the sensor device. The activation means is therewith particularly galvanically separated from any electronic system and/or other electronic components or the sensor device and therewith preferably only an inductively used component. This has the advantage that the possibility of errors can be considerably reduced and therewith a reliable detection is possible.

It is further possible that at least a first deformation area with at least a first activation means is provided, particularly on the side facing the vehicle at the door handle body and at least a second deformation area with at least one second activation means, particularly on the side facing away from the vehicle at the door handle body. Further, it is possible that further deformation areas with further activation means are provided. Further, for example a first deformation area can be configured such that a tensile load of the first activation action and the second activation area are configured to exclude a compression load of a second activation action. The first deformation area and/or the first activation means can preferably be assigned to the first activation action and/or the second deformation area and/or the second activation means to the second activation action. Thereby, the first activation is for example a first function like the unlocking or opening of the electric lock and the second activation action a second function like the locking or closing of the lock. Therewith, the advantage is achieved that a flexible operation of the exterior door handle can occur.

Within the scope of the invention a further advantage is achievable when a first sensor device and a second sensor device are provided within the door handle body, wherein particularly the first sensor device is configured for the inductive measurement at the first deformation area and the second sensor device is configured for the inductivity measurement at the second deformation area. Likewise, the first sensor device can hereby be assigned to a first activation action with a first function and the second sensor device to a second activation action with the second function. The first activation action thereby comprises for example a tensile load and/or the second activation action comprises for example a tensile load at the door handle body. The first activation action preferably occurs in the first deformation area and the second activation action preferably occurs in the second deformation area. The first and second sensor device can for example be electrically connected to one another or independent from one another and/or configured galvanically separated from one another. Alternatively or additionally, it is possible that the second sensor device or a further sensor device is configured to take over the function of the first sensor device in case of an error of the first sensor device occurs and to survey the first activation means in the first deformation area. Hereby, an increased failure safety can be ensured.

Further, it can be provided that the wall in the deformation area of the door handle body comprises a structural adjustment, particularly a recess and/or a material weakening, wherein preferably the wall and/or the door handle body preferably only in the area of the structural adjustment and particularly due to the structural adjustment comprise for the detection with the sensor device sufficient elastic deformability which particularly is increased in comparison with the deformability of the areas of the door handle body adjacent to the deformation area. The deformation area is thereby for example provided centrally at the door handle body and/or is surrounded by the adjacent areas. The deformation area and/or the overall surface of all deformation areas thereby comprises for example at least 2% and/or at least 4% and/or at least 8% and/or at least 10% of the overall outer area of the door handle body. Thereby, it is possible that a first structural adjustment in a first deformation area and a second structural adjustment in a second deformation area is provided. Thereby, the structural adjustment preferably is a material weakening, particularly in form of a recess of the wall of the door handle body in the deformation area. Hereby, it can be ensured that a small deformation is metrologically detectable by the activation action at the door handle body by the sensor device. Thereby, the structural adjustment, particularly the recess, can preferably be arranged at the door handle body such that a deformation measureable by the sensor device upon gripping the door handle body with the hand of the user occurs by the performance of the activation action.

Within the scope of the invention a further advantage is achievable when the structural adjustment at the outer side at the door handle body, particularly at the wall in the deformation area, is configured. Thereby, it can be possible that the structural adjustment meaning, particularly the recess is configured explicitly visible from the outside by the user. This has the advantage that for the user the activation area for the performance of the activation action is shown in the deformation area. Alternatively or additionally, it is possible that the structural adjustment and/or a further (second) structural adjustment is only configured at the inner side of the door handle body. This leads to an externally visible, even and closed surface. Accordingly, it can be possible that the activation means is arranged at the inner side or outer side at the door handle body. Thereby, the activation means can be configured visible from the outside or in the inner space of the door handle body such that it is not recognizable from the outside by the user. Further, it is possible that the structural adjustment and/or the activation means is configured at the outer side (recognizable) and inner side (not recognizable) at the door handle body, particularly at the wall in the deformation area. Therewith, the detection can be further improved.

Within the scope of the invention it can further be an advantage that the distance between the sensor device and the activation means surveyed by the sensor device is in the area of 1 mm to 5 mm, particularly 2 mm to 3 mm. Thereby, the sensor device can for example measure deformations of approximately at least 1/10 mm, wherein with an exceeding of the determined threshold value an opening signal for opening the lock by the sensor device and/or a signal for the activation of a function of the vehicle is generated. The sensor device is, therefore, for example connected with a central electronic system of the vehicle and/or with a safety system of the vehicle. Particularly, the distance or the alteration of the distance between the sensor device and the activation means is thereby metrologically detected by the sensor device in order to enable a reliable detection of the activation action.

Within the scope of the invention it can further be an advantage that an area between the sensor device and the actuation means and preferably an inner space of the door handle body is at least partially filled with a filling element, particularly a casting compound. Thereby, the filling element is preferably arranged in the area of the distance between the sensor device and the activation means surveyed from the sensor device. The filling element, thereby, particularly serves for the sealing of moisture penetrating from outside the door handle body and can for example be configured as a filling pack and/or foam material and/or cast compounds.

Within the scope of the invention it can further be an advantage that the sensor system technology, particularly a capacitive sensor system with at least one sensoric element is provided within the door handle body (for example in the inner space/cavities). The sensor system thereby particularly serves for detecting an action, particularly an approaching at the exterior door handle, particularly at the door handle body in order to perform a positive detection of the corresponding action with a positive detection of the corresponding action function of the vehicle like for example a locking and/or unlocking of the electric lock and/or a central locking of the vehicle. Hereby, for example in case of a positive detection a corresponding control signal can be transmitted to a control unit of the vehicle and/or a safety system of the vehicle by the sensor system. Thereby, it can be possible that the function of the vehicle controlled by the sensor system differs from the function of the sensor system controlled by the sensor device. Thus, for example only by the sensor device (with the detection of the activation action) the function of the vehicle is controlled or affected that an unlocking and an opening of the electric lock occurs. Particularly, not only by the detection of the sensor system an opening can be effected. The unlocking of the lock thereby effects that the moveable part of the vehicle and/or the lock can be opened, while, with a locked lock, an activation of the exterior door handle is enabled, however the moveable part and/or the lock do not open. The opening of the electric lock has to be separated from the unlocking which effects a removing of a locking of the lock after unlocking. Hereby, a mechanically moveable door handle is for example moved mechanically in order to open the lock and/or the moveable part. With the electric lock the removing of the lock (the opening of the lock) occurs after an electric control (opening signal), wherein for example the rotary catch of the door lock by an electric controlling and possibly with a drive unit like a servo unit or a motor unit is actuated without the use of a force of application at the exterior door handle. The mechanic deflection or adjustment of the exterior door handle for opening is superfluous by such electric locks and the exterior door handle can therewith be arranged mainly immobile at the moveable part. The opening signal which is preferably send from the sensor device with the detection of the activation action effects therewith, particularly the opening of the electric lock such that the exterior door handle is only used immobily at the moveable part as the handle for opening the moveable part.

Likewise, subject matter of the invention is a method for a detection of an activation action at an exterior door handle of the vehicle, particularly for an activation of an electric lock of the vehicle. Hereby, it is provided that the activation action is performed by a user at the door handle body of the exterior door handle in a deformation area and a sensor device within the door handle body performs an inductivity measurement in order to detect the activation action. It is thereby particularly provided that by the inductivity measurement a deformation of the door handle body is detected with the activation action. Further, it is particularly provided that the sensor device is beared independent from the deformation area at at least one sensor bearing point for the detection of the activation action such that by the inductivity measurement a deformation of the door handle body (during the activation action) is detected, particularly (only) in the deformation area. Therewith, the method according to the invention provides the same advantages like they are described in detail in relation to the exterior door handle according to the invention. Further, the exterior door handle according to the invention can be used for the method according to the invention.

Further, according to the invention, preferably at least one of the following steps for the detection of the activation action and/or for the activation of a function of the vehicle are performed, particularly performed one after the other:

a) Surveillance of the deformation area and/or an inductive activation means in the area of the deformation area by an inductivity measurement by the sensor device, wherein the inductivity measurement is performed particularly constantly or intermittently or in cyclic intervals and/or initiated by an electronic (control) system.
b) Evaluation of an inductivity value measured by an inductivity measurement in order to detect the deformation of the door handle body (due to the activation action), wherein the measured inductivity value is particularly compared with a predefined threshold value.
c) Positive detecting of the activation action by the sensor device when a minimum determined degree of the deformation is recognized, particularly with an exceeding of the threshold value by the measured inductivity value.
d) Triggering a function of the vehicle when the activation action is positively detected.

The function of the vehicle for example is an activation of the electric lock and/or the activation of a function of the safety system of the vehicle. The function can for example comprise the unlocking and/or opening of the electric lock and/or the moveable part, wherein for opening for example an opening signal by the sensor device during the detection of the activation action is emitted. For the detection of the activation action for example a certain and/or sufficient degree of deformation has to be existent which affects a correspondingly great inductivity alteration measureable by the sensor device. The indirect measurement of this deformation by the sensor device can for example occur by a determination of at least one corresponding threshold value which at least comprises one inductivity value which is at least measured during the appearance of the deformation. Therewith, a reliable detection of the activation action is possible.

According to a preferable embodiment of the invention it can be provided that the door handle body is configured elastically deformable in the deformation area and at least one inductive activation means is arranged in the deformation area, particularly in and/or at a wall of the door handle body, wherein the sensor device is arranged for detecting the activation action spaced apart to the activation means such that the deformation of the door handle body is recognized by the inductivity measurement. Since preferably the door handle body and particularly the wall of the door handle body can be configured at least mainly from plastic the activation means acts particularly as an electric conductor with a preferably defined geometry which comprises a reproducible and/or known alteration of the induction of the activation means during the deformation by the activation action. Therewith, by the inductivity measurement reliably an activation action can be detected by the surveillance of an alteration of the inductivity of the activation means.

According to an advantageous embodiment of the invention it can be provided that the sensor device, particularly only during the detection of the activation action transmits an opening signal, particularly to the electric lock of the vehicle, wherein the detection occurs particularly with the recognition of the deformation of approximately 0.05 mm to 0.2 mm, preferably 0.1 mm. Thereby, for example a threshold value of 0.5 mm or 0.1 mm or 0.2 mm (possibly converted as an inductivity value) can be determined, wherein with an exceeding of the threshold value by the measured inductivity value a positive detection of the activation action and therewith a triggering or provoking (activation) of a function of the vehicle occurs. Thereby, it can be provided that the particular electrically opening signal is only transmitted by the sensor device and therewith not by another sensor system of the vehicle and/or the exterior door handle. For example a capacitive sensor of the exterior door handle should not serve for the triggering of the opening signal and therewith to the triggering or provoking of an opening of the electric lock. Since this might lead to mal operation for example by outer influence factors. In contrary to such influence factors like for example moisture due to rain or an approaching of objects the method according to the invention is mainly not sensitive for the detection of the activation action with the sensor device.

It can be provided as a further advantage that a sensor system, particularly a capacitive sensor system is provided, wherein preferably the sensor system detects an approaching of the user, particularly previous to the detection of the activation action by the sensor device. Thereby, it can be provided that a locking and/or unlocking of the lock occurs by the sensor system. The sensor system can for example comprise at least one sensoric element for example in the inner space of the door handle body. Thus, it this for example possible that a locking of the lock occurs when the sensor system determines every moving of the user from the vehicle and/or from the exterior door handle. In contrast to that an unlocking of the lock can for example occur when the sensor system detects an approaching of the user. With the detected approaching the sensor system can for example initiate that a wake-up signal is sent to the identification device and it is waited for a response signal from the identification device. With a successful authentification due to the response signal then automatically the unlocking of the lock occurs. After a successful unlocking of the lock the sensor device can for example be used to detect an activation action in order to effect an opening of the lock. Therewith, it is possible that the detection of the activation device and/or the activation of a function of the vehicle for example the opening of the lock due to the detection of the activation action only occurs when previously a positive authentification and/or an unlocking of the lock has occurred. Further, it is possible that an opening signal is only evoked and/or an opening is only effected when the activation action is detected by the sensor device. The sensor system and/or the sensoric elements can for example be at least partially arranged adjacent to the sensor device, particularly be arranged on a common circuit board.

Likewise, a safety system for a vehicle is protected, particularly for an activation of an electric lock of the vehicle. The safety system according to the invention particularly comprises an exterior door handle according to the invention and/or the electric lock and/or an identification device and is preferably operable according to a method according to the invention.

BRIEF DESCRIPTION OF THE DRAWINGS

Further advantages, features and details of the invention result from the subsequent description in which embodiments of the invention area described in detail in relation to the drawings. Thereby, the features described in the claims and in the drawings can be essential for the invention each single by themselves or in any combination. It is shown:

In the subsequent figures for the same technical features even in different embodiments the identic reference signs are used.

DETAILED DESCRIPTION OF SPECIFIC EMBODIMENTS

Figure 1:
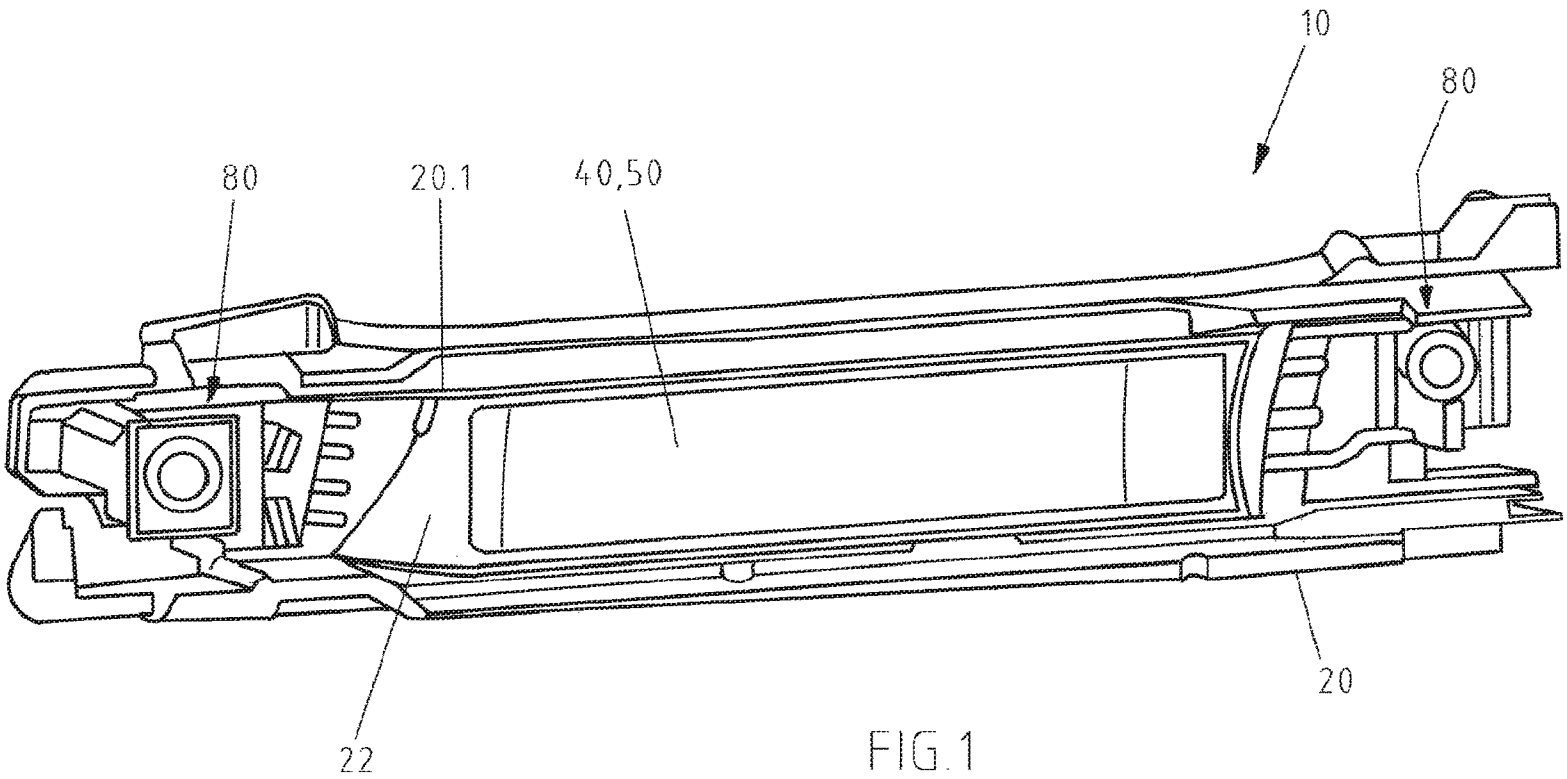
FIG. 1 a schematic perspective view of an exterior door handle according to the invention, FIG. 2 a further schematic perspective view of an exterior door handle according to the invention, FIG. 3 a schematic sectional view of an exterior door handle according to the invention, FIGS. 4-8 further schematic sectional views of an exterior door handle according to the invention, FIG. 9 a schematic view of a safety system according to the invention FIG. 10 a schematic view of method steps for visualizing a method according to the invention, FIG. 11 a schematic view of a circuit board of the exterior door handle according to the invention and FIG. 12 a further schematic view of a circuit board of the exterior door handle according to the invention.

FIG. 1 schematically an exterior door handle 10 according to the invention is shown, particularly the side of the exterior door handle 10 facing away from the vehicle. The exterior door handle 10 according to the invention comprises a door handle body 20 with a wall 22 wherein according to FIG. 1 a part of the wall 22 facing away from the vehicle is not shown in order to be able to show the inner side 20.1 of the door handle body 20. The wall 22 meaning a vehicle related part of the wall 22 and a part of the wall 22 facing away from the vehicle which is for example shown in FIG. 3 thereby configure a (at least partially closed) inner space (cavity) 20.3. The represented exterior door handle 10 can be releasably or detachably, particularly movably or immovably attached or fixed and/or geared by a fastening device 80 particularly in the area of a first bearing point 81*a* and/or a second bearing point 81*b* at a movable part 1 of the vehicle 3. At the inner side 20.1 of the wall 22 facing the motor vehicle possibly in a deformation area 40 a connecting means and/or a structural adjustment 50 is provided for example in form of a recess. In this area, particularly in the connecting means like an adhesive, for example an activation means 60 can be arranged which can be surveyed by a sensor device 30. It is further enabled that the activation means 60 is directly applied to the wall 22 in the deformation area 40 for example as a coating.

Figure 2:
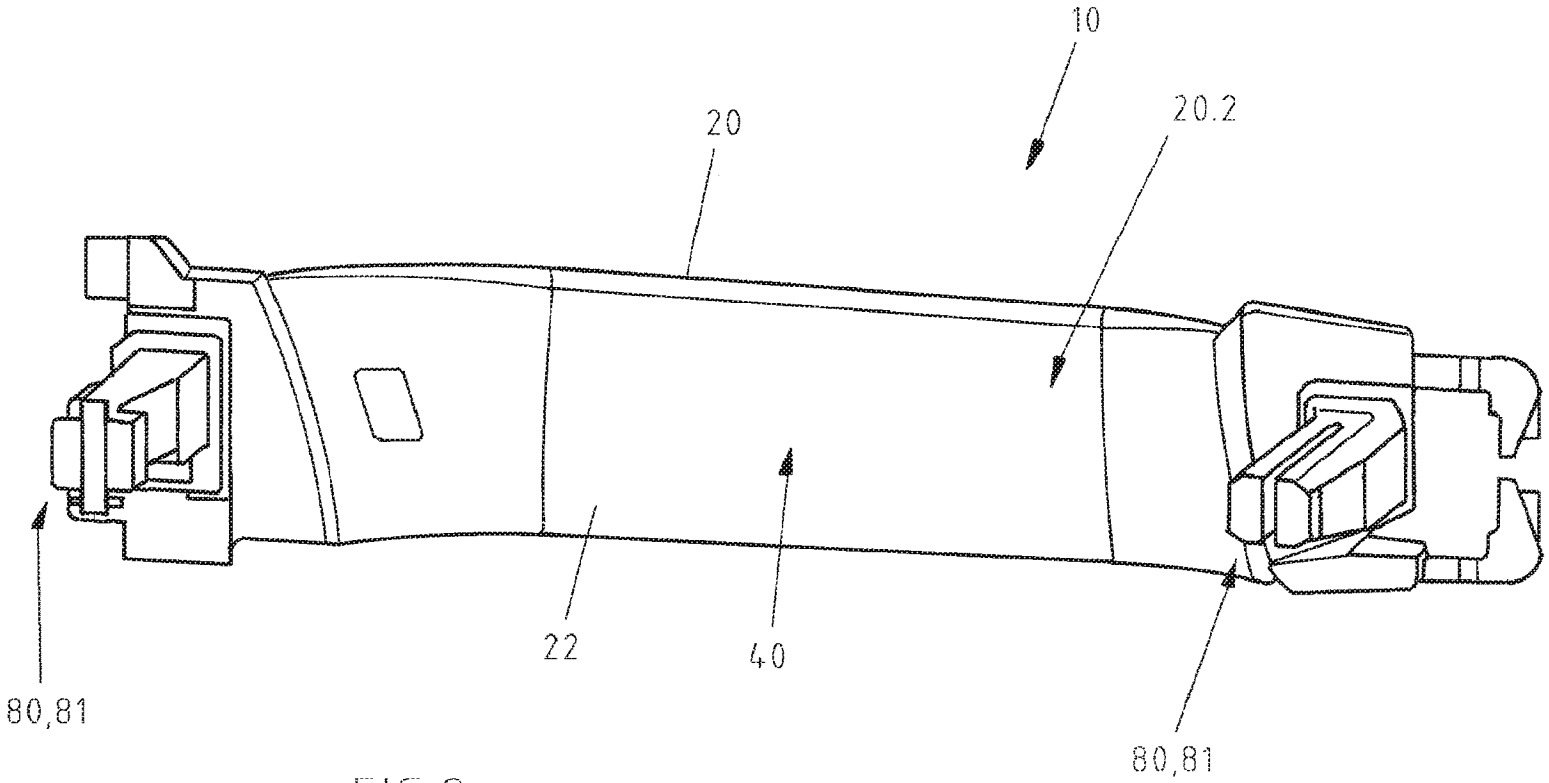

In FIG. 2 schematically the side of the door handle body 20 is shown which is facing the motor vehicle. Further, the fastening device 80 with corresponding bearing means at bearing points 81 can be recognised which for example can be inserted into the respective acceptance of the movable part 1. The exterior door handle 10 shown in FIG. 2 is thereby immobily or movably mounted at part 1 and therewith configured as a fixed exterior door handle 10. Thereby at least one or to or all bearing means of the fastening device 80 can be configured as a fixed bearing at the at least one bearing point 81. The at least one bearing point 81 therewith configures a fixed bearing position. Further, in FIG. 2 the deformation area 40 is characterized. It can be recognised that an outer side 20.2 of the wall 22 which is normally visible by the outside of the user 5 and an even and closed surface of the exterior door handle 10 is configured. Therewith the deformation area 40 can not be recognized from the outside by the user 5.

Figure 3:
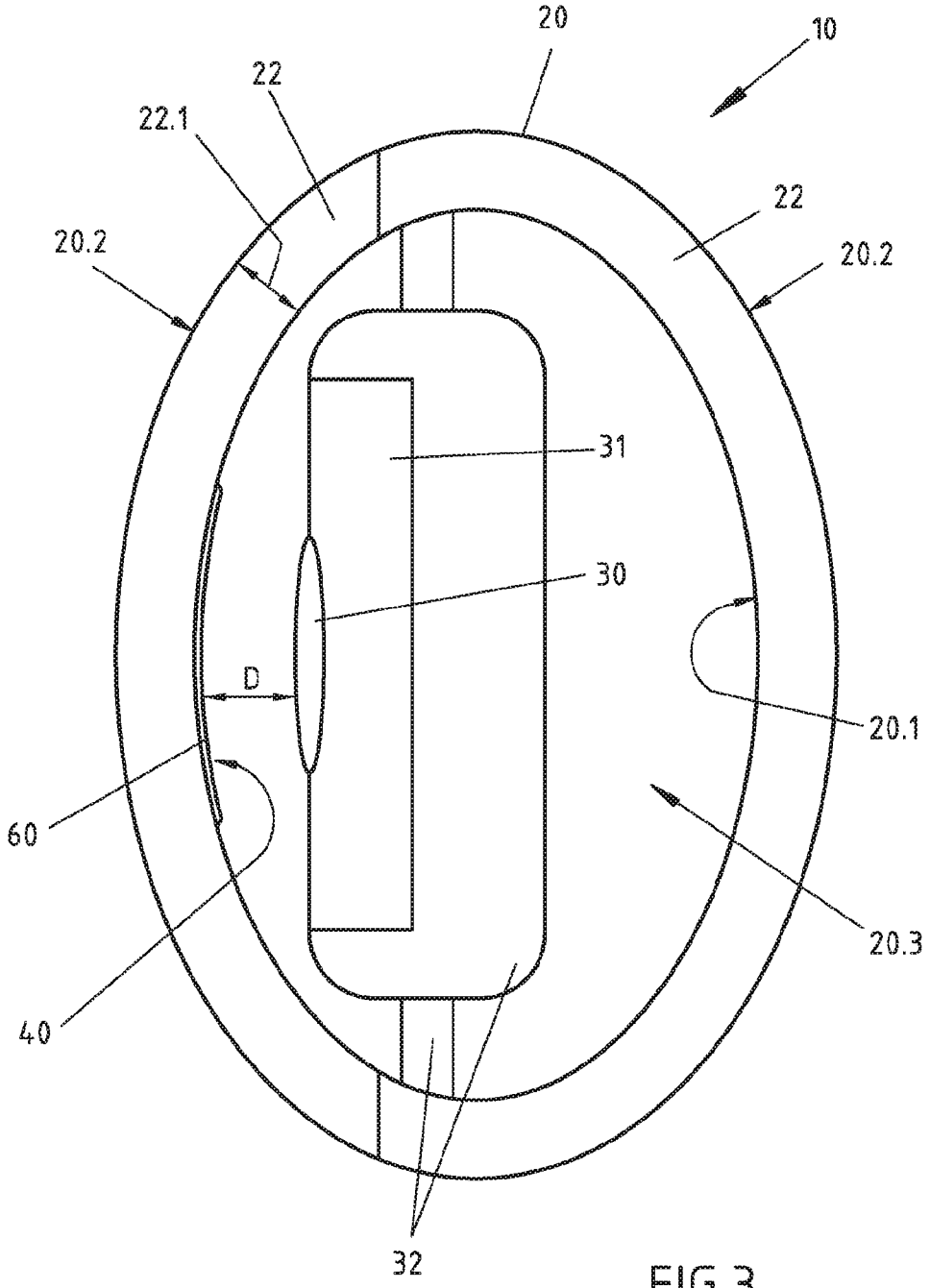
Figure 4A:
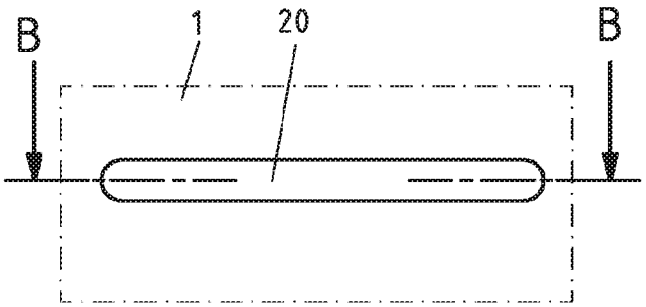
Figure 4:
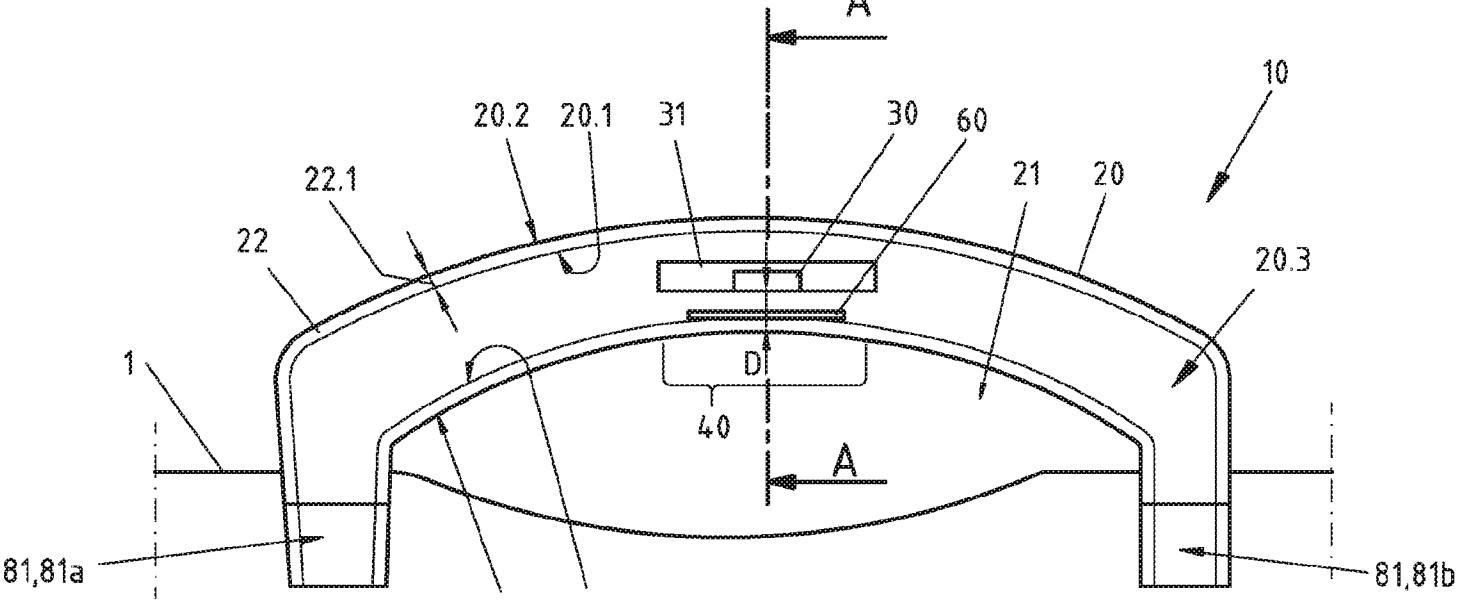

According FIG. 3 a sectional view through the sectional plane A-A characterized in FIG. 4. Here it can be recognized that the deformation area 40 configures a closed surface at the outer side at the outer side 20.2 of the door handle body 20 and at the inner side at the inner side 20.1 with the recess 50. Thereby it is visualized that a recess wall thickness 50.1 is significantly smaller than the wall thickness 22.1 of the wall 22 outside the deformation area 40. Hereby, a material weakness 50 results which enables a detectable deformation by a sensor device 30 during the activation action in the deformation area 40. The sensor device 30 is therefore arranged in a distance D to the deformation area 40 and/or of an activation means 60 in the deformation area 40. The deformability of the wall 22 in the deformation area 40 differs particularly from the deformability of the areas of wall 22 outside of the deformation area 40. Wherein the sensor device 30 with an activation action is not moved in the same manner like the wall 22 in the deformation area 40. When the sensor device 30 is mounted independent from the deformation area 40 at, at least one sensor bearing point 33, however, a structural adjustment 50 is necessarily not required. Even with an erroneous recess 50 it can be achieved due to the bearing of the sensor device 30 independent from the deformation area 40 that the deformation of the door handle body 20 is recognizable by the inductivity measurement. The structural adjustment 50 thereby effects a further increase of the sensitivity of the measurement.

The sensor device 30 is arranged in a distance D from the deformation area 40 and/or from an activation means 60 in the deformation area 40. Further, it can be provided that the sensor device 30 is arranged on a circuit board 31 and/or electrically connected with an electronic system (possibly) on the same circuit board 31. The sensor device 30 is thereby arranged at a support device 32. The support device 32 is thereby configured such that a deformation in the deformation area 40 by the activation action is mainly not affecting the position of the sensor device 30 in the inner space 20. This deformation significantly and specifically affects the distance D between the sensor device 30 and the activation means 60 wherein the degree of the deformation is detectable by the distance D and/or the inductivity alteration.

Further, it is shown in FIG. 3 that the bearing of the sensor device 30 in the inner space 20.3 of the door handle body 20 is preferably independent from the deformation area 40 and/or from a bearing of the activation means 60 and/or the wall 22. Thus the sensor device 30 can for example be arranged at the wall 22 such that a deformation or a movement in the deformation area 40 does not affect (mainly or in the same manner) the position of the sensor device 30. The sensor device 30 is hereto for example mounted in a rear area of the wall 22 which is at least partially separated or separable (for example with two parts) configured from a frontal area of the wall 22 with the deformation area 40.

FIG. 4 shows a further schematic sectional view (according to the sectional plane B-B in FIG. 4*a*) of an exterior door handle 10 according to the invention wherein a recessed grip 21 is shown between a vehicle related outer side 20.2 of a wall 22 of a door handle body 20 and a movable part 1 of a vehicle 3. Further, a first bearing point 81*a* and a second bearing point 81*b* of the exterior door handle 10 are shown. The shown exterior door handle 10 is configured as a fixed exterior door handle 10 wherein a structural adjustment 50 to the inner side 20.1 of the wall 22 is provided. Further, a sensor device 30 for the surveillance of an activation means 60 is provided, wherein the activation means 60 is arranged within the recess 50 meaning in the deformation area 40. The activation means 60 is hereby particularly configured as a coating of the wall 22. In case a user 5 engages or grabs into the recessed grip 21 about the door handle body 20 and applies a force in the deformation area 40 a deformation of the wall 22 in the deformation area 40 occurs. This deformation effects that also a deformation of the activation means 60 and/or a diminishing of the distance D between the activation means 60 and the sensor device 30 occurs. The alteration of the distance D and/or the geometry of the activation means 60 can be recognized by an activity measurement by the sensor device 30 in order to detect the activation action.

Figure 5:
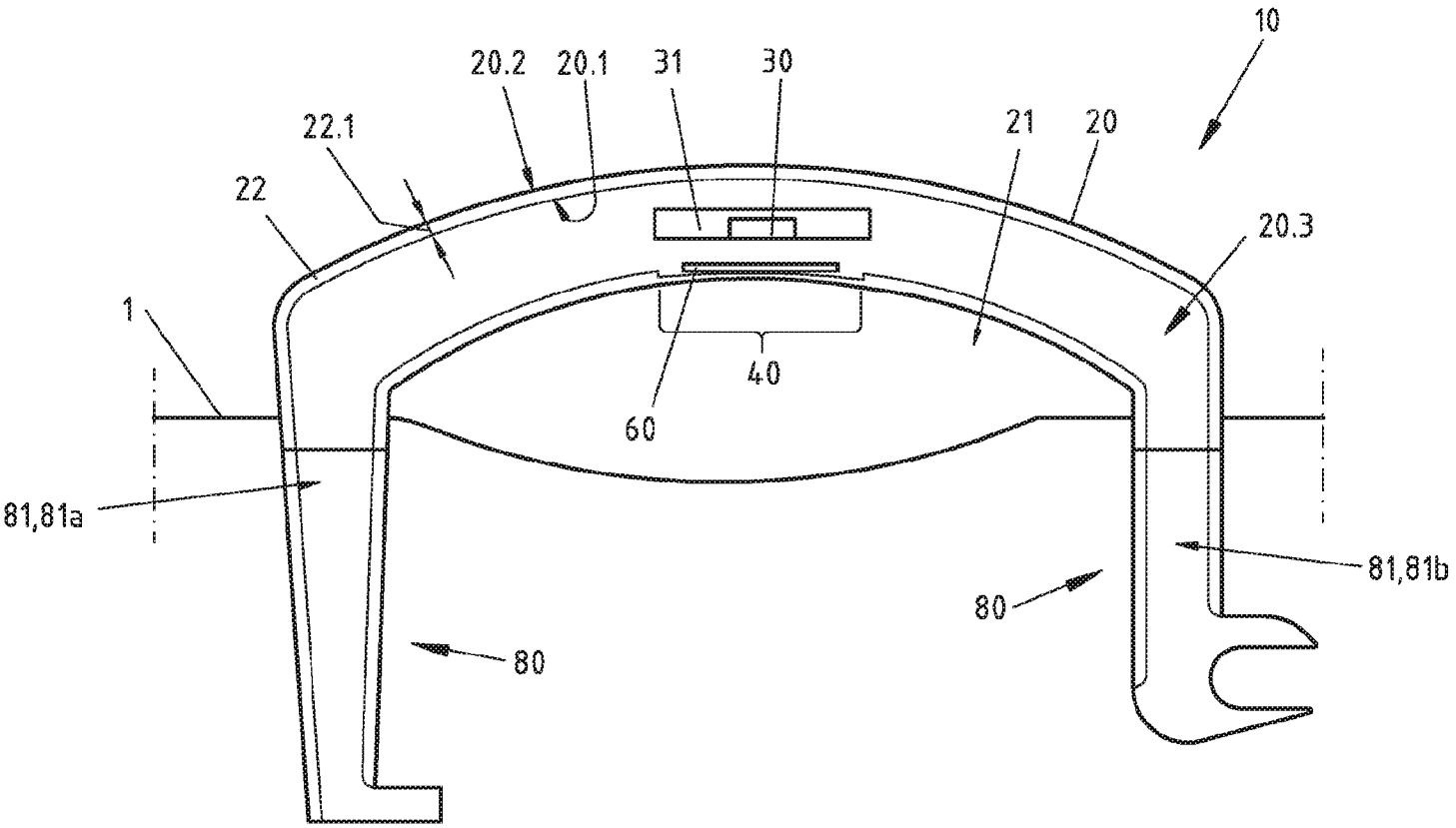

According to FIG. 5 it is possible that the exterior door handle 10 according to the invention is configured as moveably mounted, particularly pivotably mounted exterior door handle 10 at the moveable part 1. Thereby, it is shown that for the activation of the exterior door handle 10 a movement of the door handle body 20 in the direction of the arrow occurs. Additionally or at the same time thereby the application of force meaning the activation action can be detected in the deformation area 40 by the sensor device 30. It is for example possible that the sensor device 30 and the actuation of the exterior door handle 10 effects by a movement in the direction of the arrow an activation of a function of the vehicle 3 for example an opening of the electric lock 2. The activation means 60 is here for example configured as an electrically conductible plate.

Figure 6:
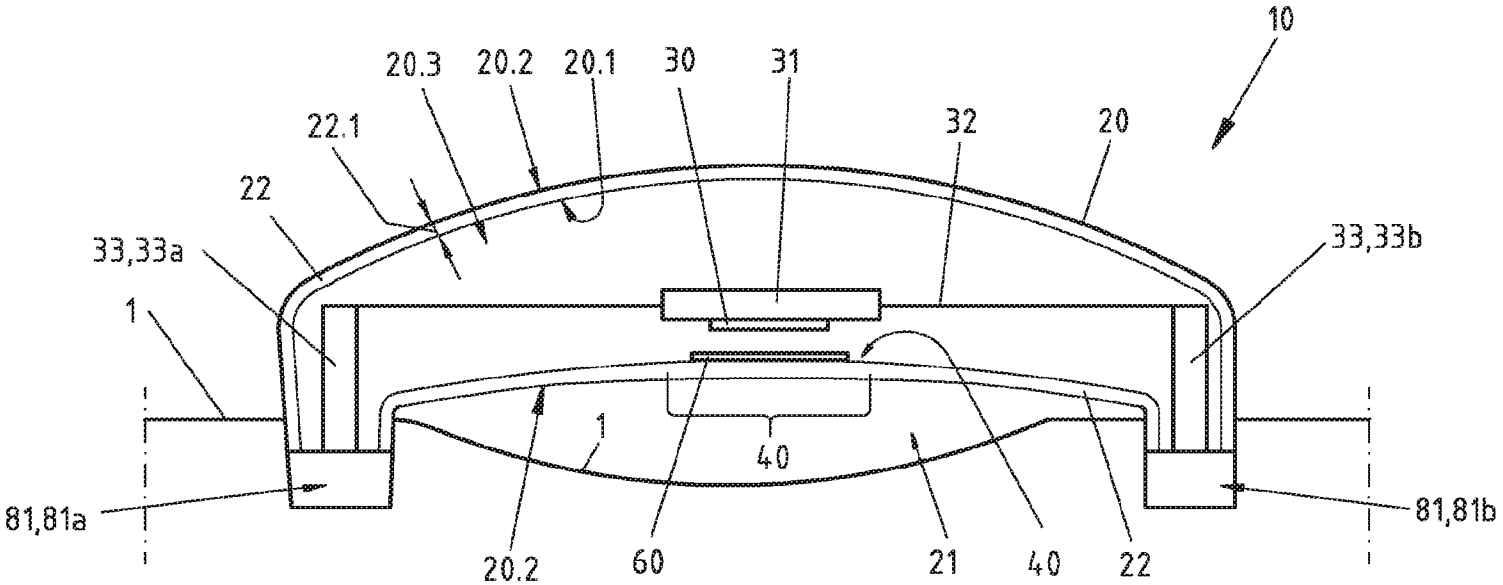

FIG. 6 shows an exterior door handle 10 according to the invention as a fixed exterior door handle 10, wherein here at the inner side a recess 50 is provided in the deformation area 40. Opposing to and spaced apart to the deformation area 40 and to an activation means 60 in the deformation area 40 a sensor device 30 is arranged which for example can be configured as an LDC sensor 30. In order to perform a particularly exact and reliable detection of an activation action by user 5 using an inductive measurement it can be provided that the sensor device 30 and/or a circuit board 31 of the sensor device 30 is mounted via a bearing device 32 independent from the deformation area 40. This is for example achieved in that the sensor device 30 is mounted via a bearing device 32 at a first bearing point 81*a* and at a second bearing point 81*b* at the exterior door handle 10 or the door handle body 20. At these positions the bearing device 32 can for example comprise sensor bearing points 33 meaning a first sensor bearing point 33*a* at a first bearing point 81*a* and a second sensor bearing point 33*b* at a second bearing point 81*b*.

Figure 7:
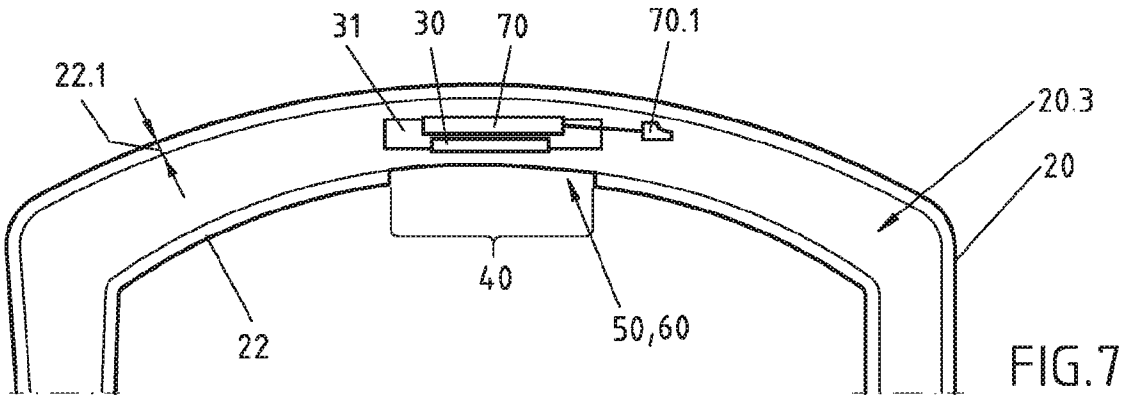
Figure 8:
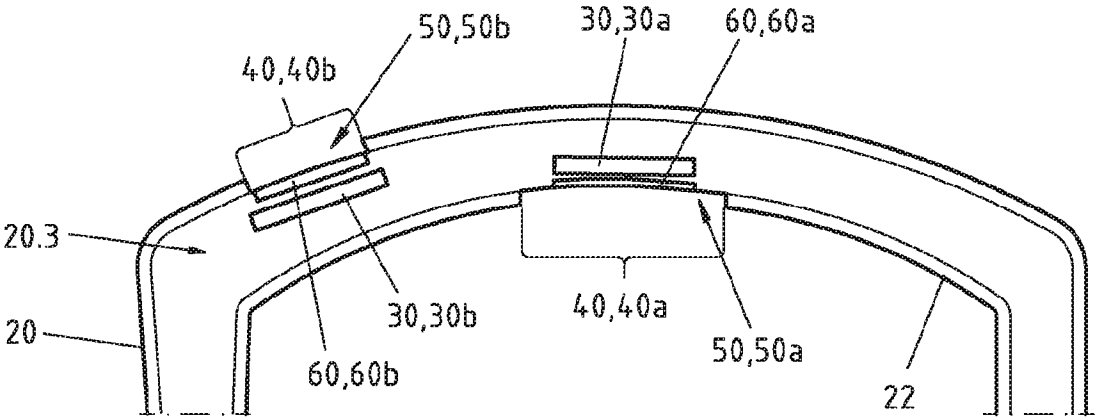

The exterior door handle 10 can preferably comprise no or only an inside structure adjustment 50. Alternatively or additionally, it is possible that according to FIGS. 7 and 8 an outer structural adjustment 50 is provided at at least one outer side 20.2 of a wall 22 of a door handle body 20 of the exterior door handle 10 according to the invention. This provides the advantage that the deformation area 40 at which particularly an activation action is performed by its user 5 is recognizable for the user. At this deformation area 40 for example an application or force can be applied to the wall 22 which affects a deformation of the wall 22 in the deformation area 40 and/or of an activation means 60 in the deformation area 40 and/or a reduction of a distance D between the activation means 62 and the sensor device 30. According to FIG. 8 thereby a first deformation area 40*a* and a second deformation area 40*b* can be provided which comprises a structural adjustment respectively. In the area of a first structural adjustment 50*a* in the first deformation area 40*a* thereby for example a first activation action and a second structural adjustment 50*b* in the second deformation area 40*b* a second activation action can be performed by the user 5 which affect the activation of different functions of the vehicle 3 respectively. Thus, for example a tensile stress by the first activation action can affect an opening and a compression load in the second deformation area 40*b* can affect a closing of the electric lock 2 by the second activation action. Accordingly, a first sensor device 30*a* for the conveyance of the first deformation area 40*a* and/or of a first activation means 60*a* and a second sensor device 30*b* for the conveyance of the second deformation area 40*b* and/or a second activation means 60*b* are provided. According to FIG. 7 further a sensor system 70 can be provided with at least one sensoric element 70.1 in order to detect further actions of the user 5. Hereby, for example an approaching by the user 5 can be detected in order to activate further functions of the vehicle 3 or a safety system 6 of the vehicle 3.

Figure 9:
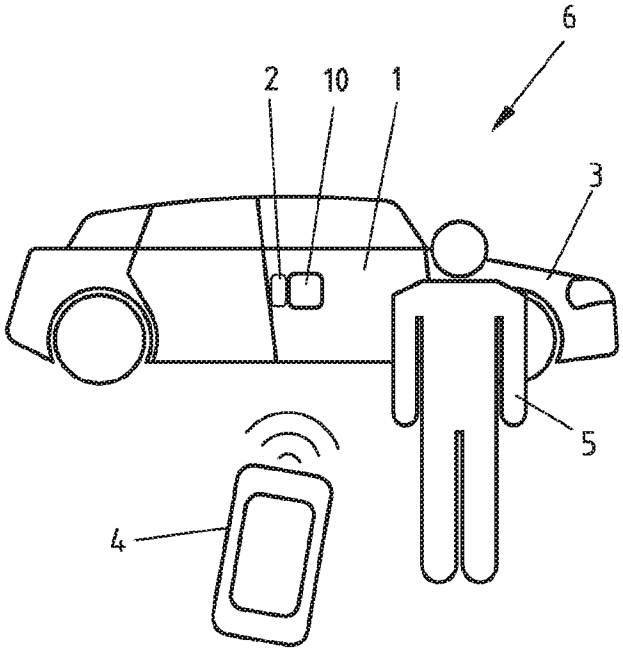

In FIG. 9 schematically a safety system 6 according to the invention of a motor vehicle 3 is shown, wherein for example a sensor system 70 detects an approaching of the user 5. Further, it can be provided that a wake-up signal to an identification device 4 is sent in order to initialize an authentification process. Thereby, it can be provided that only after a successful authentification an opening of an electric lock 2 can occur by the activation action which is detected by a sensor device 30.

Figure 10:
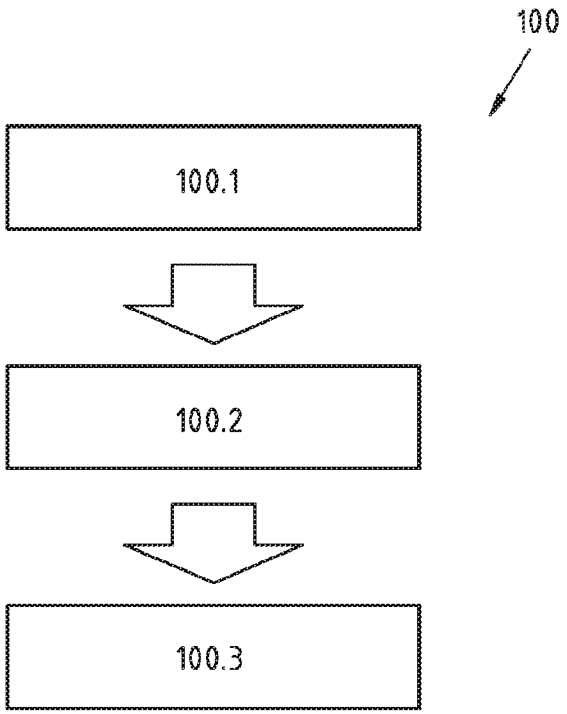

In FIG. 10 schematically a method according to the invention is visualized. Thereby, according to a first method step 100.1 an activation action by a user 5 is performed at a door handle body 20 of an exterior door handle 10 in the deformation area 40. According to a second method step 100.2 by a sensor device 30 within the door handle body 20 an inductivity measurement is performed in order to detect activation action. According to a third method step 100.3 by the inductivity measurement a deformation of the door handle body 20 is detected due to the activation action.

Figure 11:
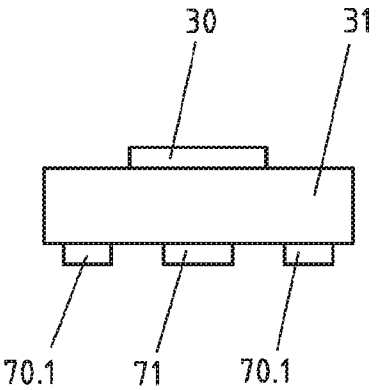

In FIG. 11 a lateral view of a circuit board 31 is shown, wherein it is shown that the sensor device 30 is arranged together with the sensoric elements 70.1 and electronic components 71 at the circuit board 31. The sensor device 30 is thereby arranged on the side of the circuit board 31 facing the deformation area 40.

Figure 12:
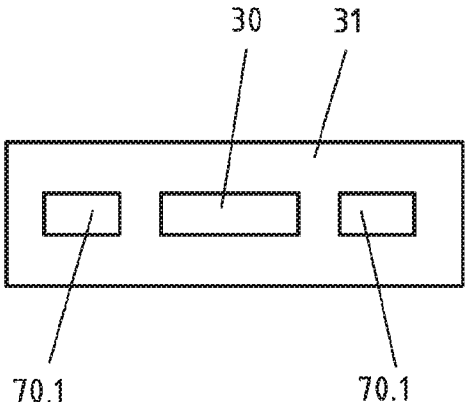

In FIG. 12 a further view of a circuit board 31 is shown as a top view. The arrangement of the sensor device 30 on the circuit board 31 is shown, wherein adjacently at least to sensoric elements 70.1 for example capacitive sensors are provided.

The previous description of the embodiments describes the present invention only within the scope of examples. Naturally, single features of the embodiments as far as technical meaningful can be freely combined with one another without leaving the scope of the present invention.

REFERENCE LIST

1 moveable part
2 electric lock
3 vehicle
4 identification device
5 user
6 safety system
10 exterior door handle
20 door handle body
20.1 inner side
20.2 outer side
20.3 inner space
21 recessed grip
22 wall
22.1 wall thickness
30 sensor device, LDC sensor
30*a* first sensor device
30*b* second sensor device
31 circuit board
32 supporting device
33 sensor bearing point
33*a* first sensor bearing point
33*b* second sensor bearing point
40 deformation area
40*a* first deformation area
40*b* second deformation area
50 structural adjustment, recess, material weakening
50*a* first structural adjustment
50*b* second structural adjustment
50.1 recess wall thickness
60 activation means
60*a* first activation means
60*b* second activation means
70 sensor system
70.1 sensoric element
71 electronic component
80 fastening device

81 bearing point
81*a* first bearing point
81*b* second bearing point
100 method
100.1 first method step
100.2 second method step
100.3 third method step
D distance

The invention claimed is:

1. An exterior door handle for a vehicle comprising:
a first portion and a second portion,
a door handle body with a wall extending at least between the first portion and the second portion,
wherein the wall is configured elastically deformable at least in at least one deformation area of the door handle body, thereby enabling a user to perform an activation action at the door handle body in the at least one deformation area,
at least one activation means which is arranged in the at least one deformation area at the wall
and configured as at least one electrically conducting element being galvanically separated from at least one sensor device,
the at least one sensor device arranged within the door handle body for inductivity measurements at the at least one activation means and spaced apart from the at least one activation means,
the at least one sensor device comprising at least one LDC-sensor,
a supporting device having
a first supporting element attached to the first portion and supporting the at least one sensor device at a first sensor bearing point, and
a second supporting element attached to the second portion and supporting the at least one sensor device at a second sensor bearing point opposite to the first sensor bearing point;
the supporting device thereby bearing the at least one sensor device independently from the at least one deformation area and enabling deformation of the door handle body caused by the activation action to be detected by an inductivity measurement of the at least one sensor device, whereby an alteration of a position, displacement or deformation of the wall and the at least one activation means in the at least one deformation area does not in a same manner affect a position of the at least one sensor device within the door handle body.

2. The exterior door handle according to claim 1, wherein at least a bearing point of the exterior door handle is provided at which the door handle body is supported at the vehicle and the bearing of the at least one sensor device occurs at the bearing point.

3. The exterior door handle according to claim 1, wherein at least the first sensor bearing point or the second sensor bearing point of the at least one sensor device or a bearing point of the exterior door handle is configured as a fixed bearing.

4. The exterior door handle according to claim 1, wherein the at least one sensor device is supported independently from the wall of the door handle body in the exterior door handle, in an inner space configured by the wall.

5. The exterior door handle according to claim 1, wherein the exterior door handle is configured as a fixed exterior door handle.

6. The exterior door handle according to claim 1, wherein the at least one activation means is configured at least as an electrically conducting film and/or an electrically conducting coating, being galvanically separated from the at least one sensor device.

7. The exterior door handle according to claim 1, wherein the at least one deformation area comprises a first deformation area and a second deformation area, and the at least one activation means comprises a first activation means and a second activation means;
the first deformation area is provided with at least the first activation means on a side at the door handle body facing to the vehicle and the second deformation area is provided with at least the second activation means.

8. The exterior door handle according to claim 1, wherein a first sensor device and a second sensor device are provided within the door handle body.

9. The exterior door handle according to claim 8, wherein the at least one deformation area comprises a first deformation area and a second deformation area, wherein the first sensor device is configured for an inductivity measurement at the first deformation area and the second sensor device for an inductivity measurement at the second deformation area.

10. The exterior door handle according to claim 1, wherein the wall in the at least one deformation area of the door handle body comprises a structural adjustment, wherein at least the wall or the door handle body in the area of the structural adjustment comprises a sufficiently elastic deformability for the detection with the at least one sensor device.

11. The exterior door handle according to claim 1, wherein a structural adjustment is configured at an outer side of the door handle body.

12. A method for a detection of an activation action at an exterior door handle of a vehicle, wherein the activation action is performed by a user at a door handle body of the exterior door handle in a deformation area and a sensor device performs an inductivity measurement within the door handle body in order to detect the activation action, wherein at least an inductive activation means is arranged in the deformation area, spaced apart from the sensor device, and the sensor device is supported independently from the deformation area at at least one sensor bearing point for the detection of the activation action such that by the inductivity measurement a deformation of the door handle body is detected;
wherein the door handle body comprises a wall extending between a first portion of the exterior door handle and a second portion of the exterior door handle, the wall configured elastically deformable at least in the deformation area;
wherein the sensor device comprises at least one LDC-sensor, wherein the inductive activation means arranged in the deformation area at the wall is configured as at least one electrically conducting element being galvanically separated from the sensor device;
wherein the sensor device is supported by a supporting device that bears the sensor device independent from the deformation area, the supporting device having
a first supporting element attached to the first portion and supporting the sensor device at a first sensor bearing point, and
a second supporting element attached to the second portion and supporting the sensor device at a second sensor bearing point opposite to the first sensor bearing point;
wherein the independent bearing of the sensor device occurs in that an alteration of a position, displacement or deformation of the wall of the door handle body and the inductive activation means in the deformation area does not in a same manner affect a position of the sensor device within the door handle body.

13. The method according to claim 12, wherein the door handle body is configured elastically deformable in the deformation area, wherein the sensor device for the detection of the activation action is arranged spaced apart to the inductive activation means such that the deformation of the door handle body is detected by the inductivity measurement.

14. The method according to claim 12, wherein the sensor device transmits an opening signal during the detection of the activation action.

15. The method according to claim 14, wherein the sensor device transmits the opening signal during the detection of the activation action to an electric lock of the vehicle, wherein the detection occurs during the detection of a deformation of approximately 0.05 mm to 0.2 mm, or 0.1 mm.

16. The method according to claim 12, wherein a sensoric element is provided, wherein the sensoric element detects an approaching of the user.

17. The method according to claim 12, wherein an exterior door handle is used according to claim 1.

* * * * *